United States Patent [19]

Hallam et al.

[11] Patent Number: 4,884,511

[45] Date of Patent: Dec. 5, 1989

[54] ALUMINUM HOPPER CAR WITH CAST COLLARS INTERCONNECTING INTERSECTING CENTER SILL HOOD WITH RIDGE HOOD AND SLOPED END WALLS

[75] Inventors: Keith J. Hallam, Norcross; Kenneth H. Smith, Powder Springs, both of Ga.

[73] Assignee: Thrall Car Manufacturing Company, Chicago Heights, Ill.

[21] Appl. No.: 149,151

[22] Filed: Jan. 27, 1988

[51] Int. Cl.[4] ..... B61D 7/00; B61F 1/02

[52] U.S. Cl. ..... 105/247; 105/248; 105/418; 105/419

[58] Field of Search ..... 105/253, 245, 248, 249, 105/416, 418, 419, 244, 247, 250, 251, 404, 411, 413, 414

[56] References Cited

U.S. PATENT DOCUMENTS

| | | | |
|---|---|---|---|
| 881,884 | 3/1908 | Dodds | 105/253 |
| 884,324 | 4/1908 | Dodds | 105/253 |
| 983,277 | 2/1911 | Harringan | 105/248 |
| 1,048,312 | 12/1912 | Ingoldsby | 105/245 |
| 1,300,959 | 4/1919 | Hart | 105/253 X |
| 1,461,732 | 7/1923 | Hart | 105/249 |
| 2,060,156 | 11/1936 | Wine | 105/249 |
| 3,242,878 | 3/1966 | Floehr | 105/253 X |
| 3,509,827 | 5/1970 | Sutter | 105/253 X |
| 3,538,857 | 11/1970 | Larssen | 105/416 X |
| 4,361,096 | 11/1982 | Funk | 105/253 X |

*Primary Examiner*—Robert B. Reeves
*Assistant Examiner*—Joseph D. Pape
*Attorney, Agent, or Firm*—Neuman, Williams, Anderson & Olson

[57] ABSTRACT

An aluminum hopper car having a center sill hood which uses aluminum collar castings to connect cross ridge hoods which intersect a center sill hood, and to connect the center sill hood with intersecting sloped car end walls.

10 Claims, 5 Drawing Sheets

FIG. 8
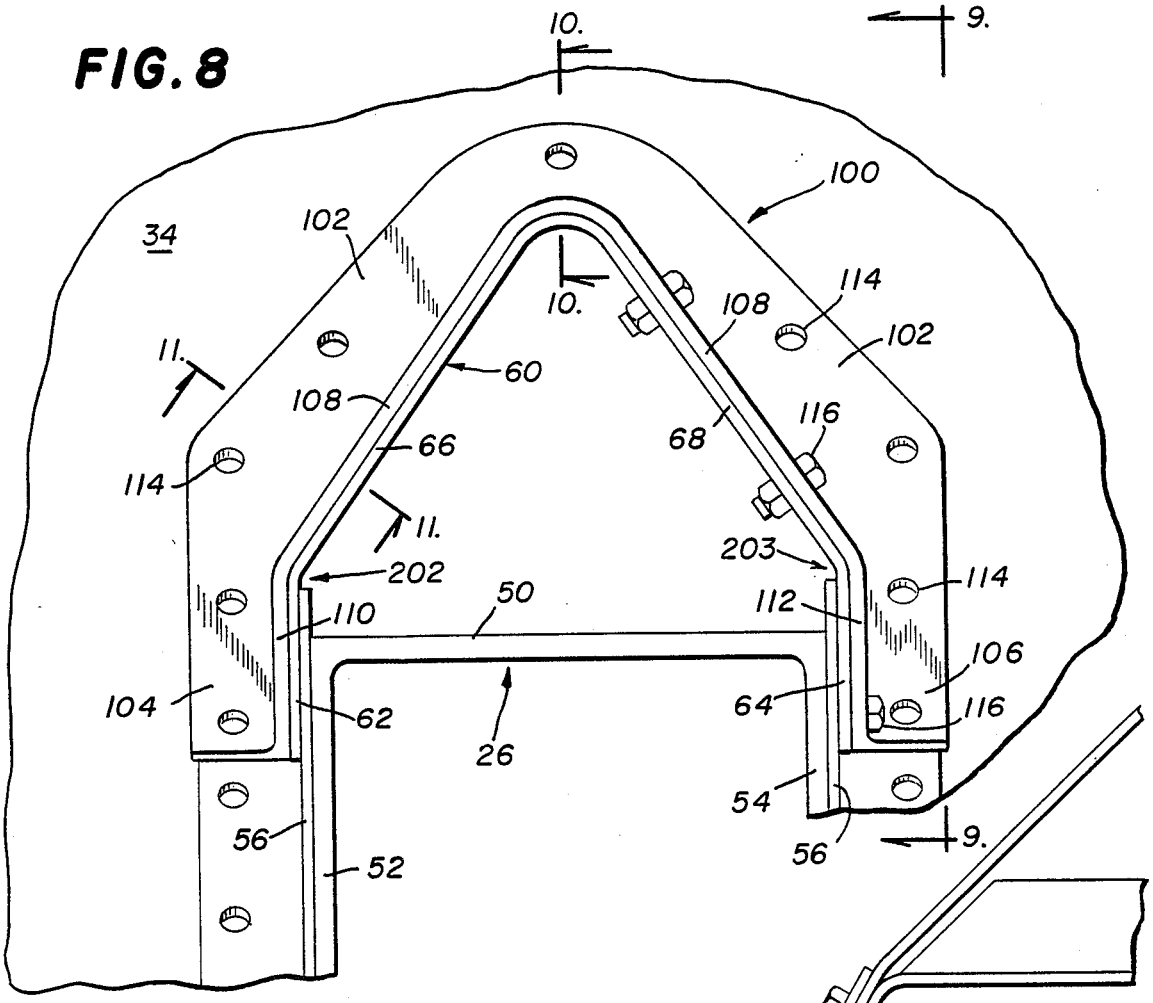
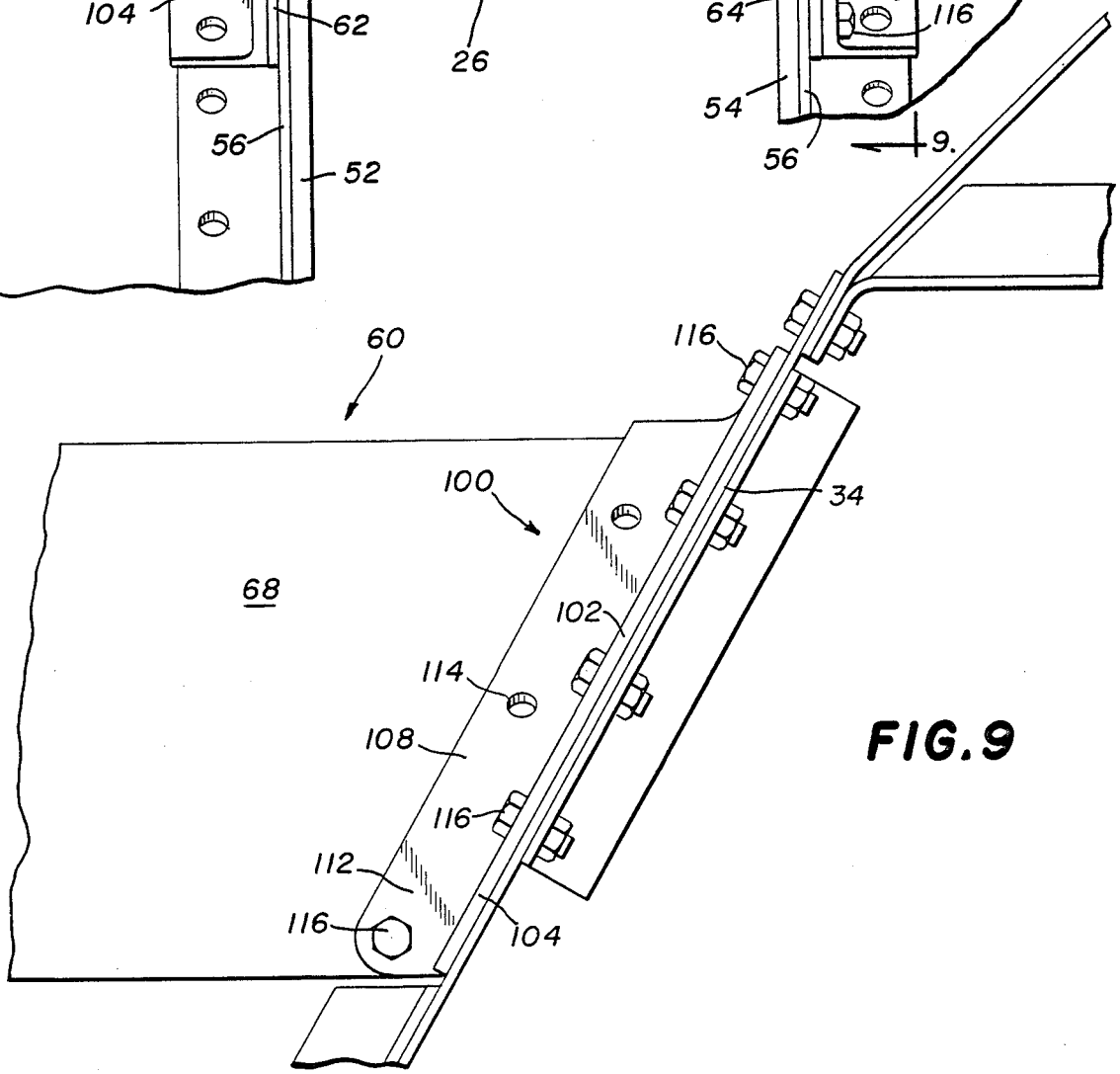
FIG. 9

ALUMINUM HOPPER CAR WITH CAST COLLARS INTERCONNECTING INTERSECTING CENTER SILL HOOD WITH RIDGE HOOD AND SLOPED END WALLS

This invention relates to railroad cars. More particularly, this invention pertains to an aluminum hopper car having a center sill hood which intersects cross ridge hoods and sloping end walls and the use of cast aluminum collars to interconnect the intersecting hoods and sloping end walls.

BACKGROUND OF THE INVENTION

Railroad hopper cars are used to transport a wide variety of aggregate lading such as coal, gravel, crushed stone, phosphate fertilizer rock and the like. Most of the cars produced up to the present time have been made of steel and when a corrosive product is to be transported the cars have been coated with various materials to protect the steel.

Because of the increased fuel costs which have occurred in recent years, continuous efforts have been made to reduce the empty weight of railroad cars to lower fuel consumption. Considerable car weight reduction has been achieved by new car designs. However, it has been realized that to further reduce car weight the use of steel must be reduced as much as possible by use of lighter substitute materials. Presently, the most promising material is aluminum because it is light weight, available at reasonable cost and has good corrosion resistant properties.

Aluminum hopper cars, especially for carrying coal and similar aggregate materials, have been recently developed. Such cars, however, realistically require a steel center sill to carry the loads and withstand train buff and draft forces. To protect the steel center sill against corrosion, and to facilitate unloading of the cargo, the steel center sill is covered by a peaked or gabled aluminum center sill hood. The aluminum center sill hood intersects aluminum cross ridge hoods, which cover discharge door operating apparatus, and the car sloped end walls. Joining these intersections by aluminum welds was expected to provide joints of adequate strength but that was found to be an erroneous assumption because they failed in use. A need accordingly exists for an alternative system for suitably interconnecting such intersections.

SUMMARY OF THE INVENTION

According to the invention there is provided an aluminum hopper car for carrying coal and other aggregate materials comprising a car body having a center sill supported by a railway truck at each end; the center sill having opposing sides and a top; the car body having a pair of spaced apart substantially vertical side walls and a pair of inwardly sloped end walls; the center sill being covered by a longitudinal hood having spaced apart walls, which abut the center sill sides, and a top which is substantially gable shaped in lateral vertical section; the center sill hood intersecting each sloped end wall; a plurality of laterally spaced apart horizontal cross ridge hoods extending between the car side walls and intersecting the center sill hood; the cross ridge hoods being substantially gable shaped in lateral vertical section; a cast aluminum cross ridge collar interconnecting the intersection of each cross ridge hood with the center sill hood; and the cast aluminum cross ridge collar having a first flange with a face in contact with and joined to the center sill hood and a second flange with a face in contact with and joined to the cross ridge hood.

Each cross ridge hood can have two sloped top portions and vertical lower portions, and each center sill hood can have two sloped top portions and vertical lower portions whereby at the intersections of a cross ridge hood with the center sill hood there are intersections of four surfaces which form four-point corners of intersection; the cross ridge collar can have substantially the shape of an inverted V with angled leg portions at the end of each collar flange; and means can join the collar to the center sill hood and cross ridge hood intersecting surfaces so as to span the four-point corners of intersection.

The aluminum hopper car desirably includes a sloped end wall cast aluminum collar interconnecting the intersection of each sloped end wall with the center sill hood, with the sloped end wall collar having a first flange with a surface in face contact with the sloped end wall and a second flange with a surface in face contact with the center sill hood and with the firs and second flanges forming a right angle.

Each center sill hood can have two sloped top portions and vertical lower portions which intersect a sloped end wall whereby intersections of three surfaces are present and form three-point corners of intersection; the sloped end wall cast aluminum collar can have substantially the shape of an inverted V with angled leg portions at the end of each collar flange; and means can join the sloped end wall cast aluminum collar to the center sill hood and sloped end wall intersecting surfaces so as to span the three-point corners of intersection.

BRIEF DESCRIPTION OF THE DRAWINGS

FIG. 8 is a view taken along the line 8—8 of FIG. 3;

FIG. 9 is a view taken along the line 9—9 of FIG. 8;

DETAILED DESCRIPTION OF THE DRAWINGS

To the extent it is reasonable and practical the same or similar elements which appear in the various views of the drawings will be identified by the same numbers.

Figure 1:
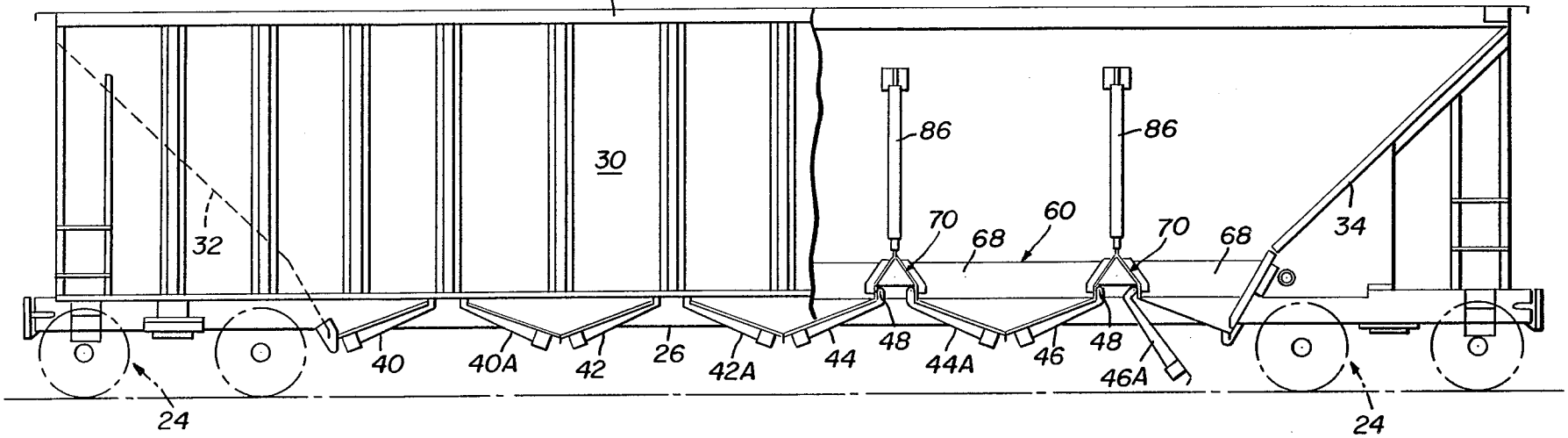
FIG. 1 is a side elevational view, partially broken away, of a railroad car according to the invention.
Figure 2:
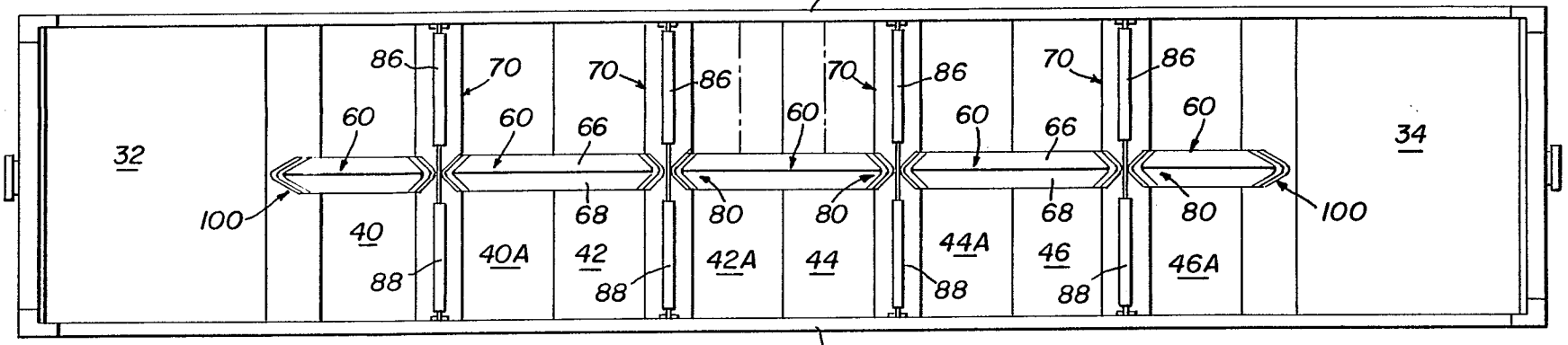
FIG. 2 is a plan view of the railroad car shown in FIG. 1.

With reference to FIGS. 1 and 2, the railroad car 20 has an aluminum body 22 supported at each end by conventional four wheel two axle trucks 24. The car body 22 is supported by a steel center sill 26 which is supported at each end by one of the car trucks. The car body 22 has opposing substantially vertical aluminum side walls 28,30 and aluminum inwardly sloped walls or sheets 32,34 at the ends of the car. The car is intended to transport coal and similar aggregate materials which can be readily and quickly emptied by gravity flow through bottom discharge openings having pivotal doors or gates located along the bottom of the car body.

The car 20, as shown in FIGS. 1 and 2, has four pairs of doors 40,40A; 42,42A; 44,44A and 46,46A. Each door is connected to the car body by a horizontal pivot pin or hinge 48 positioned to be substantially lateral to the car body and center sill 26. It is intended that the two doors of each pair operate in unison but rotate in opposite directions when being opened and in opposite directions when being closed. Additionally, for rapid discharge of the car lading, all doors are intended to be fully opened substantially simultaneously, and also subsequently fully closed substantially simultaneously. Accordingly, the car is illustrated in FIGS. 1 and 2 with some doors closed and some doors open primarily to show the positions which the doors take with respect to the car body when opened and closed. Apparatus for operating the doors is disclosed in U.S. Pat. Nos. 4,688,488; 4,132,177; 3,710,729; 3,596,609; and 3,596,608.

The longitudinal center sill 26 has a flat horizontal top 50 and opposing sides 52,54. Triangular inboard aluminum side hopper sheets 56,58 are positioned along the sides of the center sill to help define the discharge openings closed by the doors. Aluminum is used for this purpose to protect the steel center sill.

The top of center sill 26 is covered by a longitudinal aluminum center sill hood 60 having spaced apart vertical walls 62,64 which are located adjacent the center sill sides 52,54, and a symmetrical gable top consisting of two sloped portions 66,68. The center sill hood 60 intersects the sloped end walls 32,34 at each end of the car body. The aluminum center sill hood 60 prevents coal from contacting the center sill and causing it to corrode and, in addition, its sloped shape facilitates flow of coal out of the discharge openings.

The body 22 has four identical spaced apart lateral aluminum gable shaped cross ridge hoods 70 which extend the width of the car and are joined at their outer ends to the bottom body side walls 28,30. The cross ridges cover and protect hinges which pivotally support the discharge doors 40-46 and one or more shafts which form part of the door opening and closing apparatus. The cross ridge hoods 70 also serve to define lateral side edges of the discharge openings located in the bottom of the car.

Figure 3:
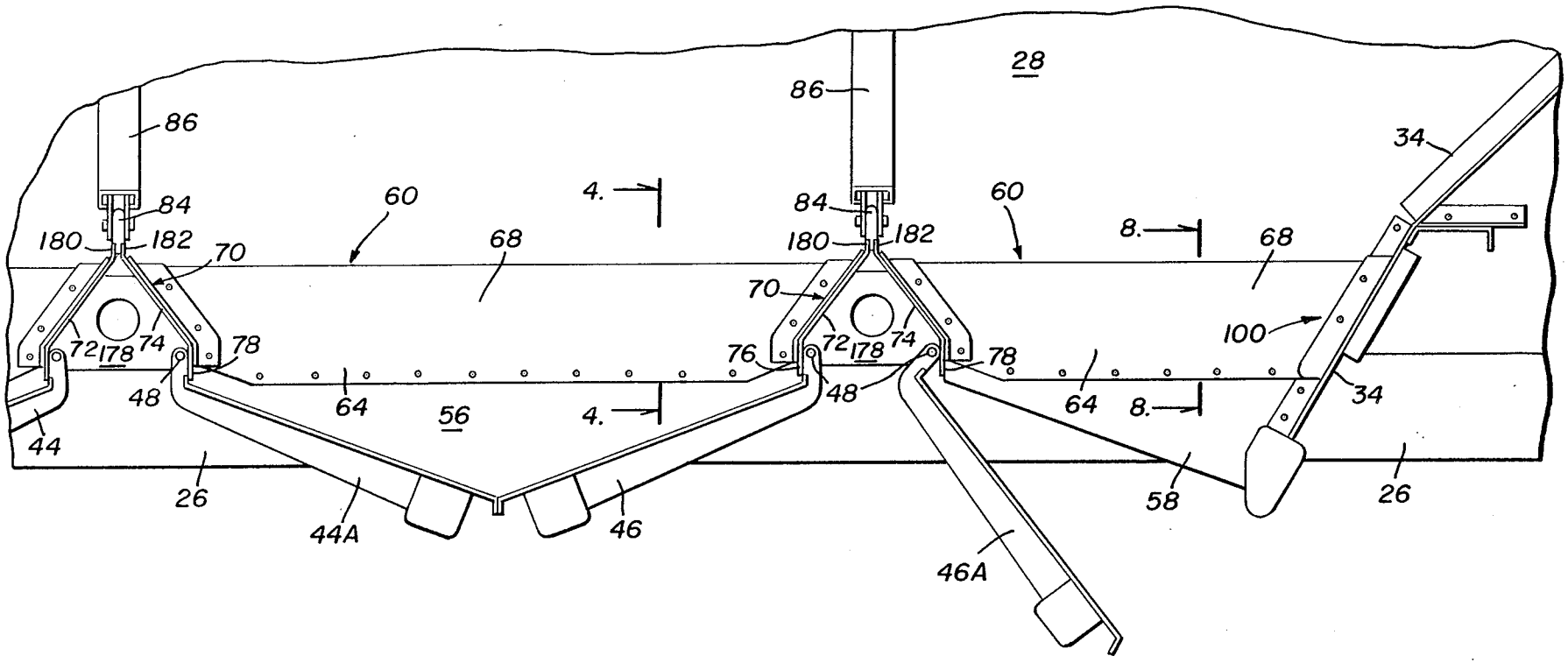
FIG. 3 is an enlarged side elevational view of the lower right side end portion of the railroad car shown in FIG. 1.
Figure 4:
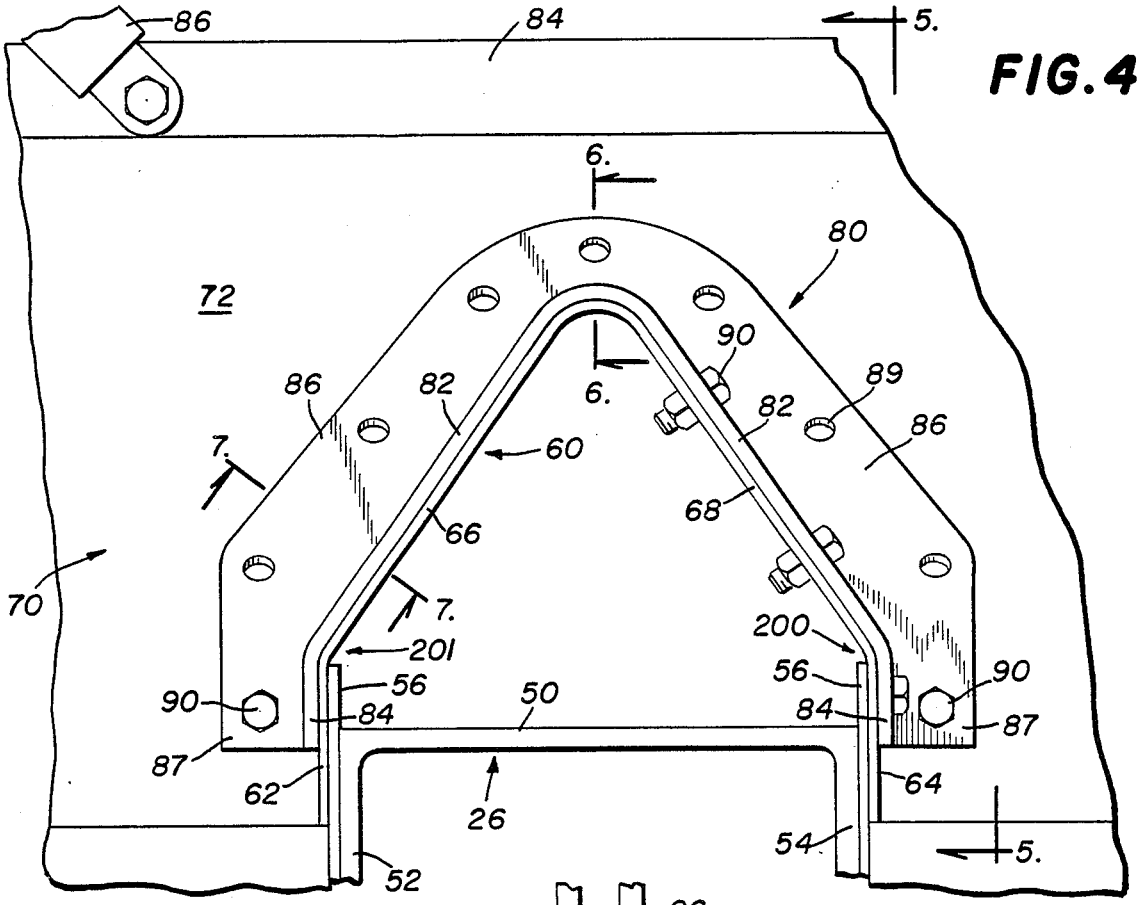
FIG. 4 is a view taken along the line 4—4 of FIG. 3.
Figure 5:
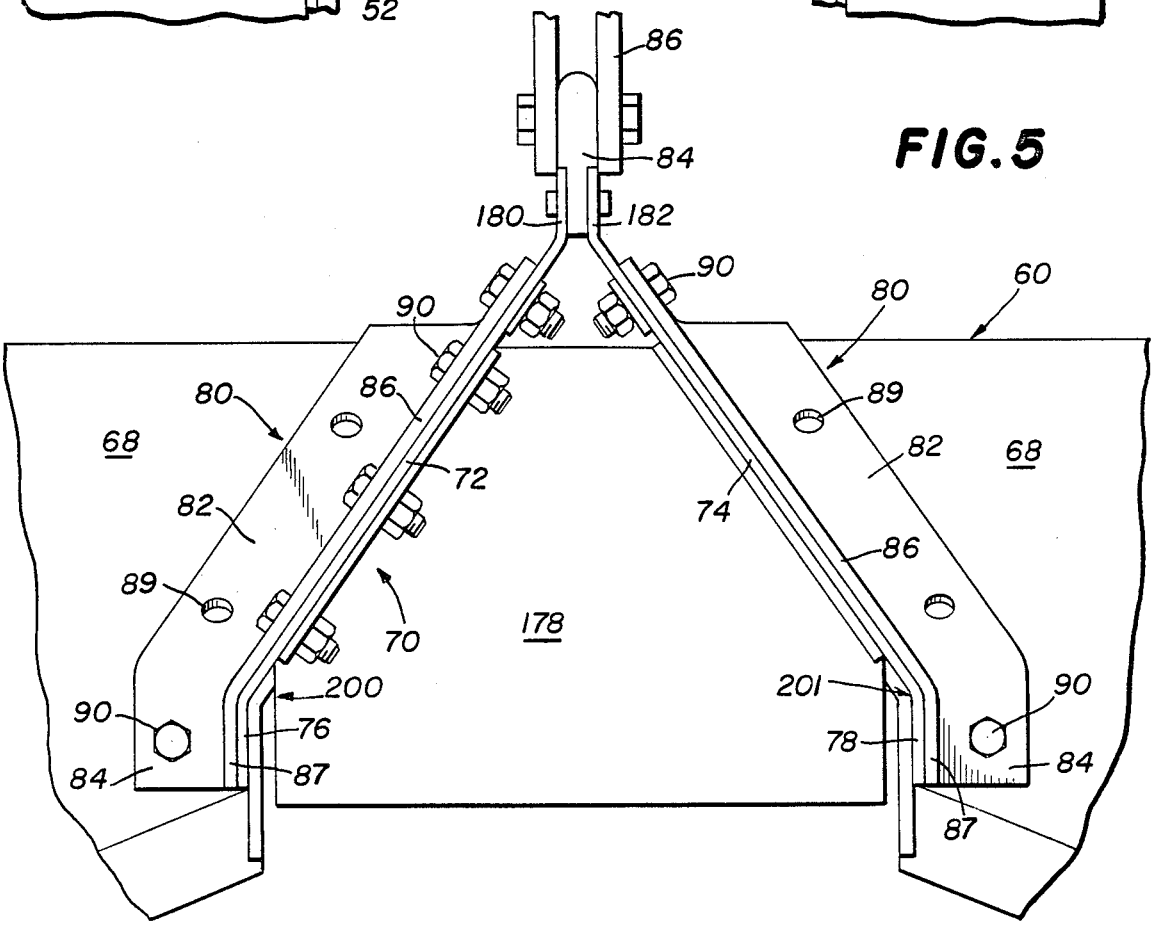
FIG. 5 is a view taken along the line 5—5 of FIG. 4.
Figure 6:
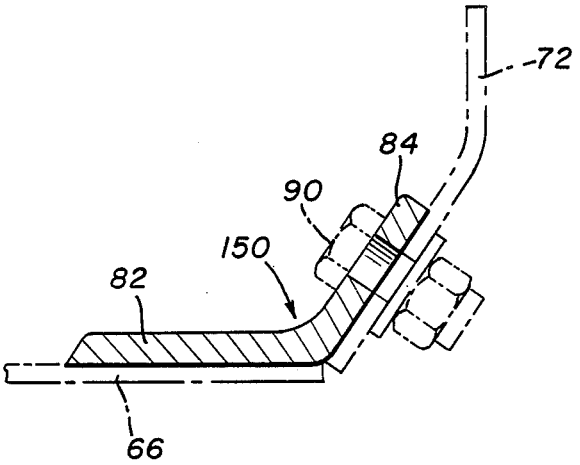
FIG. 6 is a sectional view taken along the line 6—6 of FIG. 4.
Figure 7:
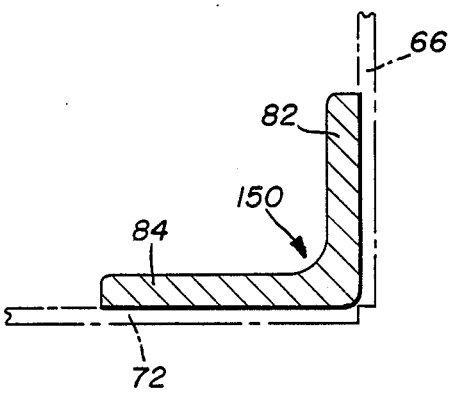
FIG. 7 is a sectional view taken along the line 7—7 of FIG. 4.

Each cross ridge hood 70 includes a pair of longitudinal aluminum oppositely sloping plates 72,74 which terminate at the bottom in vertical sides 76,78 (FIG. 5). The sloping plates 72,74 have vertical upper ends 180,182 between which a cross ridge bar 84 is bolted. Tubular aluminum braces 86,88 are connected at their lower ends to cross ridge bar 84 near the center sill and at their upper ends to body side walls 28,30. Each cross ridge hood 70 is reinforced internally by vertical spaced apart lateral ribs 178 (FIG. 3). The supports (not shown) for the door hinges also reinforce the cross ridge hoods 70.

Each of the cross ridge hoods 70 twice intersects the center sill hood 60. These intersections must be joined in such a way that applied loads do not break the joints. Particularly critical is the four-point corner 200 where wall 64, sloped portion 68, sloping plate 72, and side 76 intersect. Another critical and comparable fourpoint corner 201 is where wall 62, sloped portion 68, plate 74 and side 78 intersect. Since each intersecting hood is made of aluminum it was expected that direct aluminum welding of the joints would be adequate but that was determined to be unsuitable. Furthermore, because the two to four intersecting surfaces forming the joints are complex, reinforcing the joints by structural members is not feasible since joints are required which prevent coal and other lading from passing through. It was found, according to the invention, that a cast aluminum cross ridge collar 80 was required to interconnect the intersection of each cross ridge hood 70 with the center sill hood 60 (FIGS. 3 to 7).

Each cross ridge unitary collar 80 has a first flange 82 with a face in surface contact with and joined to the surface of center sill hood 60 sloped portions 66,68. The ends 84 of flange 82 are vertical and lie adjacent side walls 62,64 of the center sill hood 60. Each cross ridge collar 80 also has a second flange 86 and the ends 87 of this flange are vertical and lie adjacent vertical lower portions 76,78 of the cross ridge hood 70. The surface of the second flange 86 is in face contact with and joined to the cross ridge hood 70. The second flange has an outer continuous free end edge substantially uniformly spaced from the first flange. The flanges 82,86, and their respective ends 84,87, are integrally formed when the unitary collar is formed as an aluminum casting. These flanges form an integral angle with each other which coincides with the angle of intersection between the center sill hood and the cross ridge hood which, except at the top portion of the collar, is substantially 90°. The angle at the top portion is about 130° in lateral section. Neither of these angles of intersection is a sharp angle but instead they are smoothly curved areas 150 (FIGS. 6 and 7), desirably radius curves, of intersection so that coal and other aggregate can be readily shed from the car during unloading. The curved areas 150 also reinforce the casting against cracking. The collar 80 is provided with spaced apart bolt receiving holes 89 in both flanges 82,86 so that it can be secured by bolts 90 to both the cross ridge hood and center sill hood at their intersection. The collar 80 has the general shape of an inverted V so that it can be said to be yoke-shaped or peak-shaped.

The collar casting 80 has been found to be an efficient structure for joining together complex intersecting surfaces of plate aluminum which could not be successfully welded together or be suitably joined by an aluminum extrusion. The collar casting 80, because of its unitary and rigid structure, is able to join together the highly stressed four-point corners 200 and 201. The collar casting 80 also facilitates distribution of torsional loads into cross ridges. The use of mechanical fasteners, such as bolts 90, also contributes to the strength of the connection formed by the collar and the adjoining car body elements.

Figure 10:
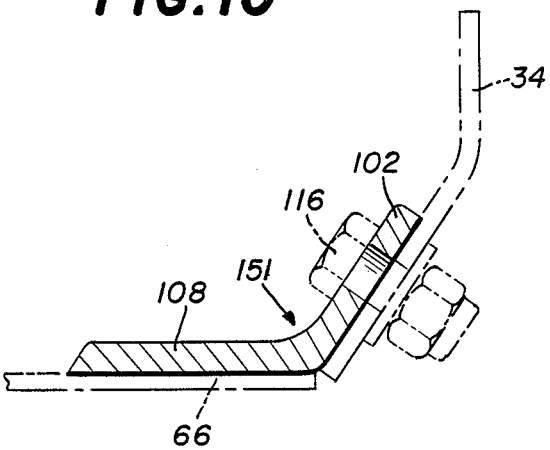
FIG. 10 is a sectional view taken along the line 10—10 of FIG. 8.
Figure 11:
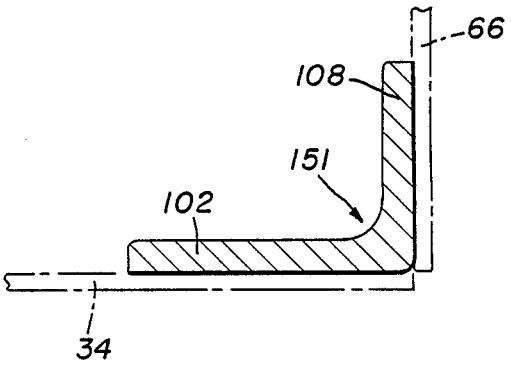
FIG. 11 is a sectional view taken along the line 11—11 of FIG. 9.

It was also found according to the invention that a cast aluminum sloped end wall collar 100 was required to interconnect the intersection of each center sill hood 70 with the sloped end walls 32,34 for the same reasons given above regarding the need to use cross ridge collar 80. As shown in FIGS. 8 and 9, the sloped end wall collar 100 has a first flange 102 with a surface in face contact with sloped end walls 32,34. The ends 104,106 of flange 102 lie adjacent the side walls 62,64 of the center sill hood 60. The sloped end wall collar 100 has a second flange 108 with a surface in face contact with the center sill hood 60. The ends 110,112 of flange 108 are vertical and are positioned adjacent to the vertical lower portions 62,64 of the center sill hood 60. The flanges 102,108, and their respective ends 104,106,110,112, are integrally formed when the collar 100 is formed as an aluminum casting. These flanges form an integral angle with each other which coincides with the angle of intersection between the center sill hood 60 and the sloped end walls 32,34. This angle is substantially 90° except at the top portion of the collar where it increases to about 135°. Neither of these angles of intersection is a sharp angle but instead they are smoothly curved areas 151 (FIGS. 10 and 11), desirably radius curves, of intersection so that coal and other aggregate can be readily shed from the car during unloading. The curved areas 151 also reinforce the casting against cracking. The collar 100 is providd with spaced apart bolt receiving holes 114 in both flanges 102,108 and their ends 104,106,110,112 so that it can be secured by mechanical fasteners, such as bolts 116, to both the center sill hood 60 and the sloped end walls 32,34.

The sloped end wall collar casting 100 has also been found to be an efficient structure for joining together complex intersecting slope end wall surfaces of plate aluminum which could not be successfully welded together or be suitably joined by an aluminum extrusion. The collar casting 100, because of its unitary and rigid structure, is able to join together the highly stressed three-point corners 202,203 (FIG. 8) formed by the intersection first, of slope sheet 34, portion 66 and wall 62 and, second, of slope sheet 34, portion 68 and wall 64.

The foregoing detailed description has been given for clearness of understanding only, and no unnecessary limitations should be understood therefrom, as modifications will be obvious to those skilled in the art.

What is claimed is:

1. An aluminum hopper car for carrying coal and other aggregate materials, comprising:

a car body having a center sill supported by a railway truck at each end;

the center sill having opposing sides and a top;

the car body having a pair of spaced apart substantially vertical side walls and a pair of inwardly sloped end walls;

the center sill being covered by a longitudinal center sill hood having spaced apart walls, which abut the center sill sides, and a top which is substantially gable shaped in lateral vertical section;

the center sill hood intersecting each sloped end wall;

a plurality of laterally spaced apart horizontal cross ridge hoods extending between the car side walls and intersecting the center sill hood;

the cross ridge hoods being substantially gable shaped in lateral vertical section;

a cast aluminum cross ridge collar interconnecting the intersection of each cross ridge hood with the center sill hood; and the cast aluminum cross ridge collar having a first flange with a face in contact with and joined to the center sill hood and a second flange with a face in contact with and joined to the cross ridge hood.

2. An aluminum hopper car according to claim 1 including a sloped end wall cast aluminum collar interconnecting the intersection of each sloped end wall with the center sill hood; and the sloped end wall collar having a first flange with a surface in face contact with the sloped end wall and a second flange with a surface in face contact with the center sill hood.

3. An aluminum hopper car according to claim 1 in which the cross ridge collar has substantially the shape of an inverted V.

4. An aluminum hopper car according to claim 1 in which:

each cross ridge hood has two sloped top portions and vertical lower portions, and each center sill hood has two sloped top portions and vertical lower portions whereby at the intersections of a cross ridge hood with the center sill hood there are intersections of four surfaces which form four-point corners of intersection;

the cross ridge collar has substantially the shape of an inverted V with angled leg portions at the end of each collar flange; and means joining the collar to the center sill hood and cross ridge hood intersecting surfaces thereby spanning the four-point corners of intersection.

5. An aluminum hopper car according to claim 4 in which mechanical fastener means joins the collar to the four intersecting surfaces.

6. An aluminum hopper car according to claim 2 in which the sloped end wall cast aluminum collar has substantially the shape of an inverted V.

7. An aluminum hopper car according to claim 2 in which:

each center sill hood has two sloped top portions and vertical lower portions which intersect a sloped end wall whereby intersections of three surfaces are present an form three-point corners of intersection;

the sloped end wall cast aluminum collar has substantially the shape of an inverted V with angled leg portions at the end of each collar flange; and means joining the sloped end wall cast aluminum collar to the center sill hood and sloped end wall intersecting surfaces thereby spanning the three-point corners of intersection.

8. An aluminum hopper car according to claim 7 in which mechanical fastener means joins the collar to the three intersecting surfaces.

9. An aluminum hopper car according to claim 1 in which the area of intersection of the collar flanges is smoothly curved to reinforce the casting and provide a smooth transition surface to facilitate shedding coal and other lading.

10. An aluminum hopper car according to claim 2 in which the area of intesection of the sloped end wall cast aluminum collar flanges is smoothly curved to reinforce the casting and provide a smooth transition surface to facilitate shedding coal and other lading.

* * * * *